US007914327B2

(12) United States Patent
Campbell et al.

(10) Patent No.: US 7,914,327 B2
(45) Date of Patent: Mar. 29, 2011

(54) ELECTRICAL CONNECTOR

(75) Inventors: Jeffrey S. Campbell, West Bloomfield, MI (US); Franklin A. Holub, West Bloomfield, MI (US); Louis M. Carrer, Rockwood, MI (US); Richard A. Johannes, Lake Orion, MI (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 12/316,520

(22) Filed: Dec. 12, 2008

(65) Prior Publication Data

US 2009/0186523 A1 Jul. 23, 2009

Related U.S. Application Data

(60) Provisional application No. 61/062,216, filed on Jan. 23, 2008.

(51) Int. Cl.
*H01R 13/40* (2006.01)

(52) U.S. Cl. ..... 439/595; 439/596

(58) Field of Classification Search ..... 439/595, 439/596, 752

See application file for complete search history.

(56) References Cited

U.S. PATENT DOCUMENTS

| | | | | |
|---|---|---|---|---|
| 5,575,692 | A * | 11/1996 | Cecil et al. | 439/752 |
| 6,773,309 | B1 | 8/2004 | Shuey | 439/701 |
| 7,044,806 | B2 | 5/2006 | Sian | 493/680 |
| 7,044,808 | B1 | 5/2006 | Foltz et al. | 493/752 |
| 7,361,036 | B2 | 4/2008 | Pittenger et al. | 439/157 |
| 7,387,545 | B2 | 6/2008 | Tyler et al. | 439/752 |
| 2004/0072464 | A1 | 4/2004 | Nakamura | 30/445 |
| 2004/0235365 | A1 | 11/2004 | Fujita | 106/248 |

FOREIGN PATENT DOCUMENTS

WO WO-2005/069686 A1 7/2005

* cited by examiner

*Primary Examiner* — Ross N Gushi
(74) *Attorney, Agent, or Firm* — Harrington & Smith

(57) ABSTRACT

An electrical connector sub-assembly including a housing having at least one electrical contact receiving area configured to receive an electrical contact; and a terminal position assurance (TPA) member located on a front section of the housing. The TPA member is laterally movable on the front section between an unlocked position and a locked position. The TPA member comprises two spaced sections configured to lock the electrical contact in the electrical contact receiving area at two spaced locations when the TPA member is moved to the locked position. This prevents unintentional withdrawal of the electrical contact from the electrical contact receiving area.

20 Claims, 8 Drawing Sheets

ELECTRICAL CONNECTOR

CROSS REFERENCE TO RELATED APPLICATION

This application claims priority under 35 U.S.C. 119(e) on U.S. Provisional Patent Application No. 61/062,216 filed Jan. 23, 2008 which is hereby incorporated by reference in its entirety.

BACKGROUND OF THE INVENTION

1. Field of the Invention

The invention relates to an electrical connector and, more particularly, to a lock for a terminal in an electrical connector.

2. Brief Description of Prior Developments

U.S. Pat. No. 7,044,806 B2 discloses an electrical connector having terminal position assurance (TPA) polarization.

SUMMARY

The following summary is merely intended to be exemplary. The summary is not intended to limit the scope of the claimed invention.

In accordance with one aspect of the invention, an electrical connector sub-assembly is provided including a housing having at least one electrical contact receiving area configured to receive an electrical contact; and a terminal position assurance (TPA) member located on a front section of the housing. The TPA member is laterally movable on the front section between an unlocked position and a locked position. The TPA member comprises two spaced sections configured to lock the electrical contact in the electrical contact receiving area at two spaced locations when the TPA member is moved to the locked position. This prevents unintentional withdrawal of the electrical contact from the electrical contact receiving area.

In accordance with another aspect of the invention, an electrical connector sub-assembly is provided comprising a housing and a terminal position assurance (TPA) member. The housing comprises electrical contact receiving areas, configured to receive electrical contacts, and at least one deflectable latch configured to latch an electrical contact in one of the electrical contact receiving areas. The terminal position assurance (TPA) member is located at a front end of the housing. The TPA member is movable on the housing between an unlocked position and a locked position, wherein the TPA member comprises a first section configured to block deflection of the deflectable latch and a second section configured to directly latch behind a portion of the electrical contact.

In accordance with another aspect of the invention, a method is provided comprising providing a housing comprising an electrical contact receiving area configured to receive an electrical contact; and connecting a terminal position assurance (TPA) member to a front section of the housing, wherein the TPA member is laterally movable on the front section between an unlocked position and a locked position, wherein the TPA member comprises two spaced sections configured to lock the electrical contact in the electrical contact receiving area at two respective spaced locations and prevent unintentional withdrawal of the electrical contact from the electrical contact receiving area.

In accordance with another aspect of the invention, a method is provided comprising providing a housing comprising electrical contact receiving areas, configured to receive electrical contacts, and at least one deflectable latch configured to latch an electrical contact in one of the electrical contact receiving areas; and connecting a terminal position assurance (TPA) member to a front end of the housing, wherein the TPA member is movable on the housing between an unlocked position and a locked position, wherein the TPA member comprises a first section configured to block deflection of the deflectable latch and a second section configured to directly latch behind a portion of the electrical contact.

BRIEF DESCRIPTION OF THE DRAWINGS

The foregoing aspects and other features of the invention are explained in the following description, taken in connection with the accompanying drawings, wherein.

DETAILED DESCRIPTION OF EMBODIMENTS

Figure 1:
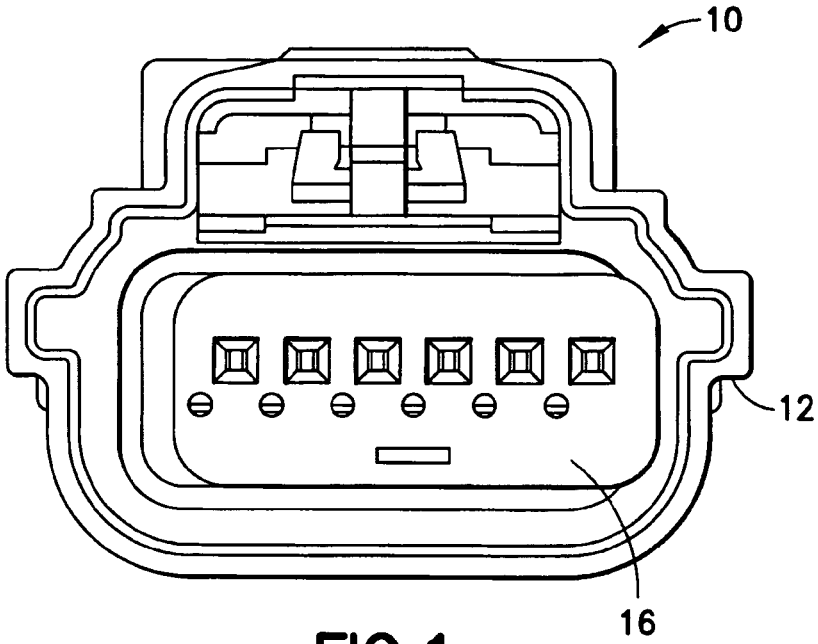
FIG. 1 is a front end view of an electrical connector incorporating features of the invention showing the TPA member in an unlocked position.

Referring to FIG. 1, there is shown a front end view of an electrical connector 10 incorporating features of the invention. Although the invention will be described with reference to the example embodiments shown in the drawings, it should be understood that the invention can be embodied in many alternate forms of embodiments. In addition, any suitable size, shape or type of elements or materials could be used.

Figure 3:
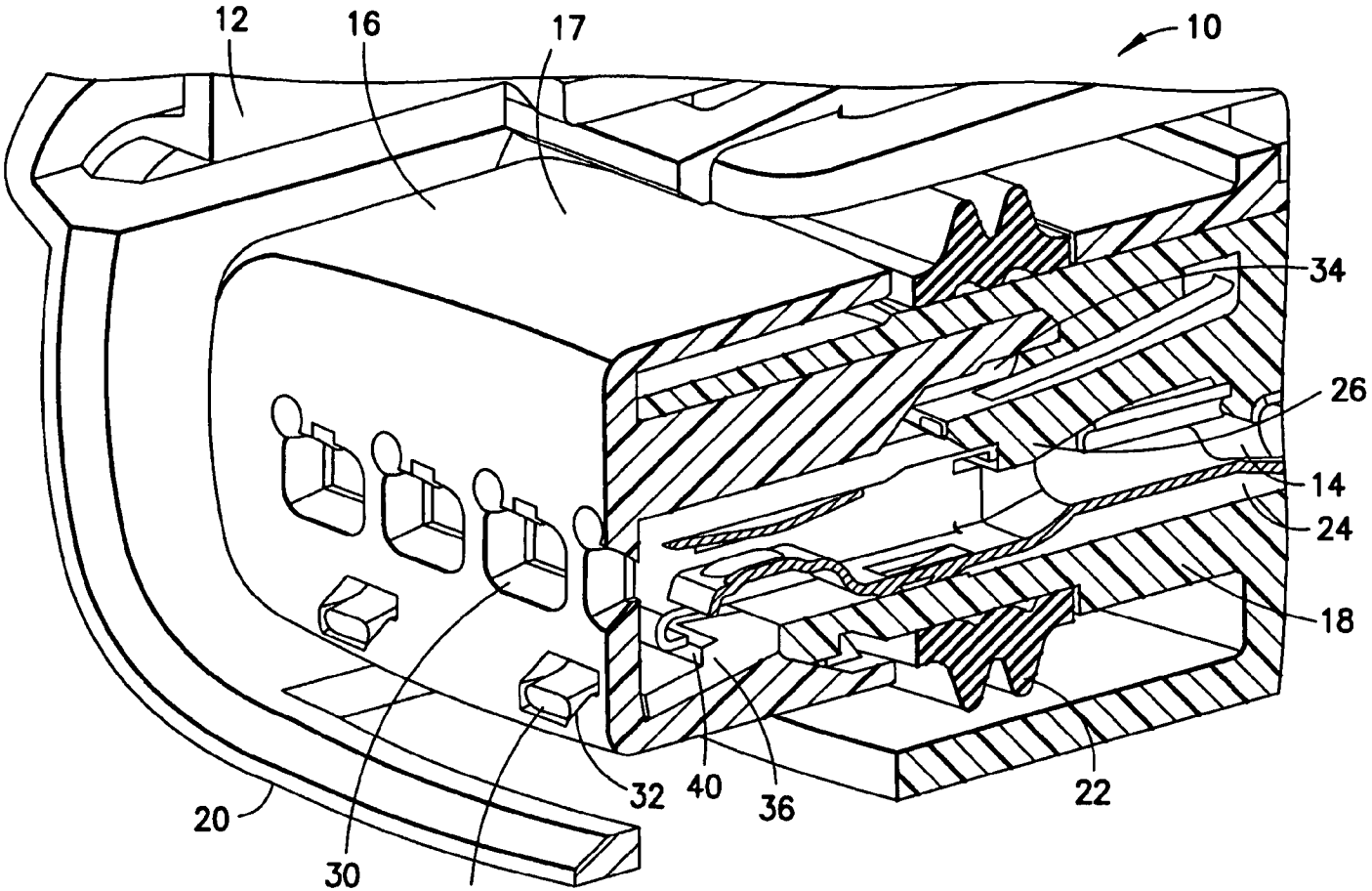
FIG. 3 is a cut away perspective view of the electrical connector shown in FIG. 1.

Referring also to FIG. 3, the connector 10 generally comprises a housing 12, terminals or electrical contacts 14, and a terminal position assurance (TPA) member or terminal lock 16. The housing 12 can comprise an inner housing 18 and an outer housing 20. However, in an alternate embodiment the housing could comprise more or less than two housing members. For example, the housing could comprise a one-piece member forming both the inner and outer housing sections. A seal 22 can be provided for sealing with a mating electrical connector (not shown). The inner housing 18 forms terminal receiving areas 24 which receive the electrical contacts 14. In this embodiment the inner housing 18 has a deflectable cantilevered latch arm 26 extending into each of the receiving areas 24. When one of the electrical contacts 14 is inserted into one of the receiving areas 24, one of the latch arms 26 can snap-lock latch with a portion of the electrical contact 14. This forms a first lock for locking the electrical contact in the housing.

Figure 2:
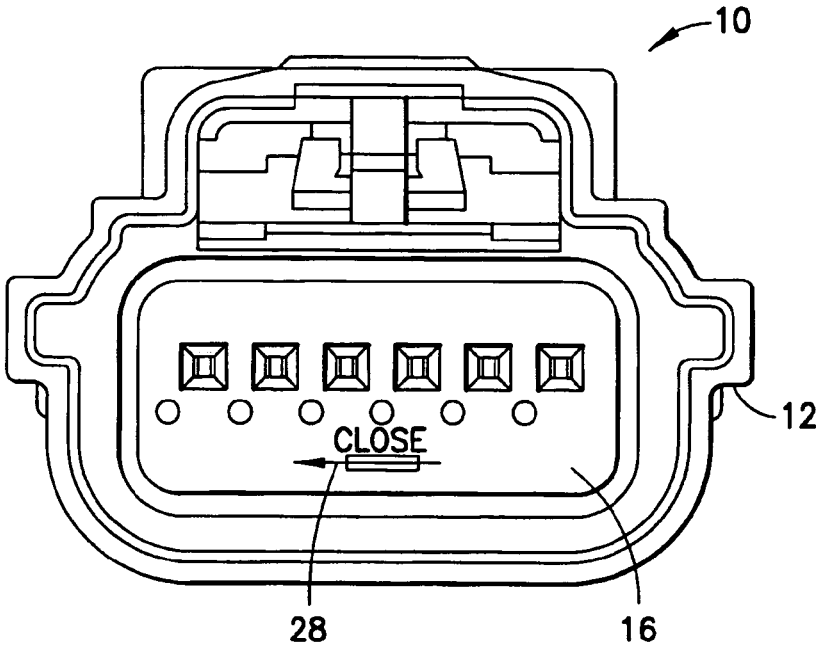
FIG. 2 is a front end view as in FIG. 1 showing the TPA member in a locked position.

Referring also to FIG. 2, the TPA member 16 is laterally movably as indicated by arrow 28 between an open, unlocked position shown in FIG. 1 and a closed, locked position shown in FIG. 2. The electrical contacts 14 are adapted to be inserted into the housing in a first direction (along the central axis of the contact receiving areas 24), and the TPA member 16 is adapted to be moved in a second direction 28 orthogonal to the first direction from the open, unlocked position to the closed, locked position. Thus, a side actuated TPA is provided. The front end of the TPA member 16 can form a forward stop for the contacts 14 in the receiving areas 24 even when the TPA member is in its open, unlocked position. Thus, the inner housing 18 does not need a forward stop for the contacts 14 and the overall connector 10 can be shorter in length than a conventional connector. When the TPA member 16 is moved to the closed, locked position, the TPA insures that the terminals 14 are properly axially positioned in the receiving areas 24, and also provide a secondary lock to lock the electrical contacts in the housing. In a preferred embodiment, the TPA member is slidably mounted on the front end of the inner housing 18, and a latch (not shown) is provided to latch the TPA member 16 in the closed, locked position on the housing.

As seen in FIG. 3, the front end of the TPA member 16 has apertures 30 to allow male contact pins (not shown) of a mating electrical connector to be inserted into the female electrical contacts 14. The front end of the TPA member 16 also comprises cam slots 32. A rear end of the TPA member 16 has portions 34 which, when moved to the locked position, overly the latch arms 26 and prevent the latch arms from deflecting out of engagement with the electrical contacts 14.

Figure 4:
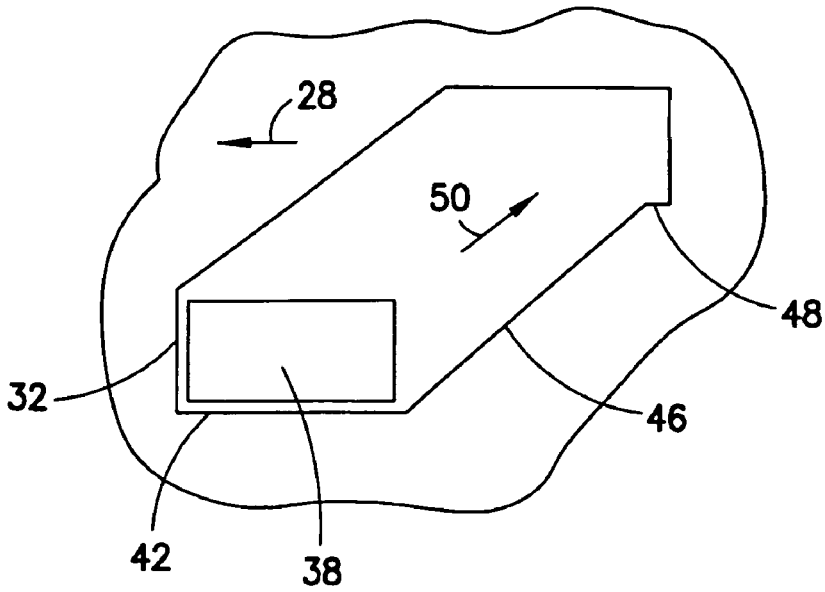
FIG. 4 is a partial front end view of the camming engagement of parts of the TPA member shown in FIG. 1 in the unlocked position.
Figure 5:
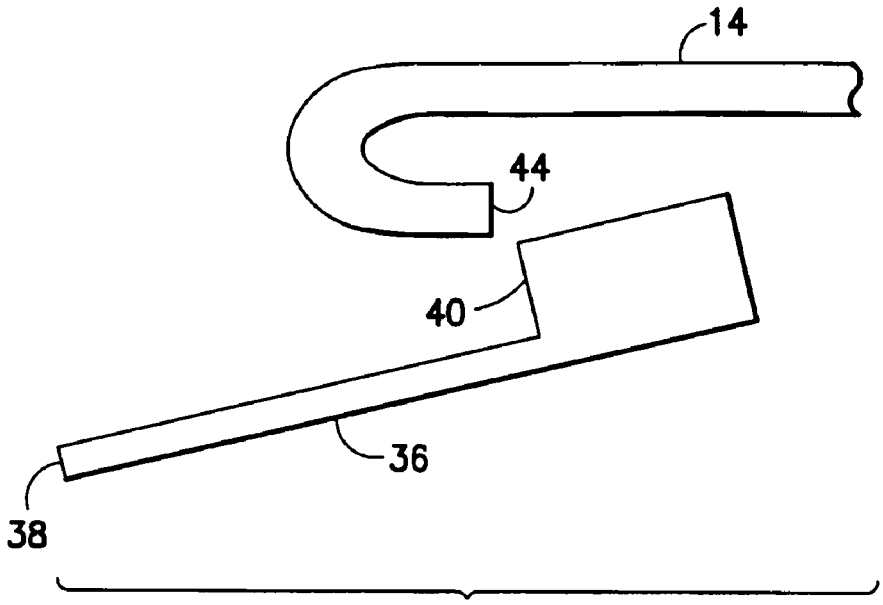
FIG. 5 is a side diagram illustrating locations of a portion of the electrical contact and a portion of the TPA member in the positions shown in FIGS. 1 and 3.

Referring also to FIGS. 4 and 5, the TPA member includes a first part 17 and a second part 36 which forms a secondary terminal locking member in this embodiment. The member 36 is part of the TPA system. In this embodiment the member 36 is a separate member from the TPA member 16 and the inner housing 18. However, in alternate embodiments, the member 36 could be integral with the TPA member 16 (such as with a living hinge for example) or the inner housing 18 (such as with a living hinge for example). The secondary terminal locking member 36 has front end projections 38 which are located in the cam slots 32. The secondary terminal locking member 36 also comprises terminal latch surfaces 40. When the TPA member is in the open position shown in FIGS. 1 and 3-5, the front end projections 38 are located in bottom portions 42 of the slots 32, and the terminal latch surfaces 40 are spaced from the latch surface 44 of the electrical contacts 14.

Figure 6:
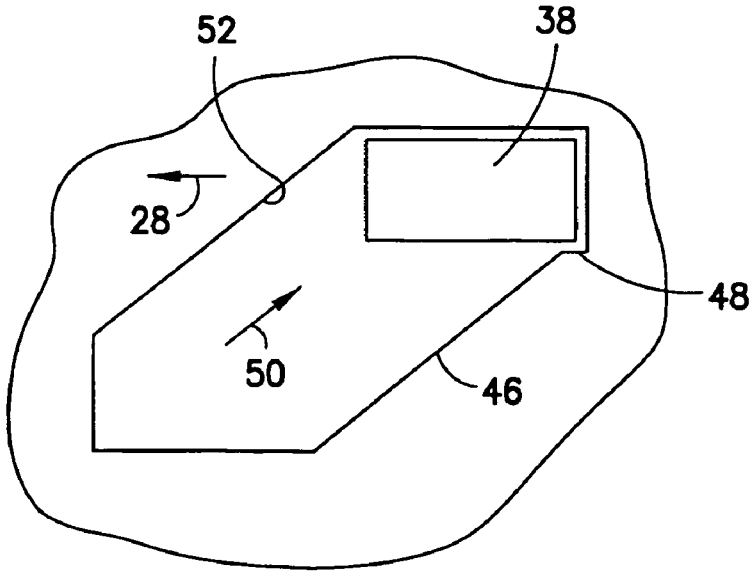
FIG. 6 is a partial front end view similar to FIG. 4 of the camming engagement of parts of the TPA member shown in FIG. 2 in the locked position.
Figure 7:
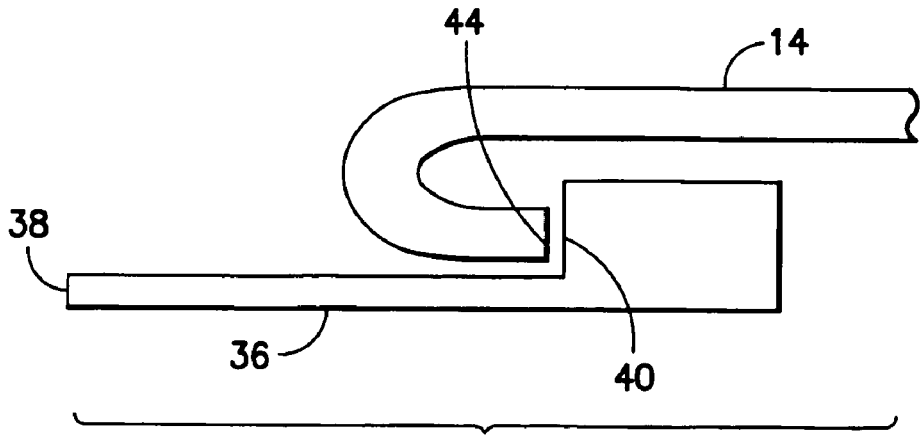
FIG. 7 is a side diagram similar to FIG. 5 showing the portions of the electrical contact and TPA member in the locked position shown in FIG. 2.

The slots 32 each have a cam surface 46 and a top portion with a ledge 48 at the opposite end from the bottom portion 42. When the TPA member 16 is moved to the closed, locked position as indicated by arrow 28, the cam surfaces 46 cause the front end projections 38 to cam upward in the slots as indicated by arrow 50. Referring also to FIGS. 6-7, the front end projections 38 are, thus, moved up onto the ledges 48 and the terminal latch surfaces 40 are moved behind the latch surfaces 44 of the electrical contacts to thereby form a secondary lock of the electrical contacts in the housing.

With this embodiment the portions 34 form a first section of the TPA system configured to block deflection of the deflectable latches 26, and the member 36 forms a second section configured to directly latch behind a portion of the electrical contact. Thus, the terminal position assurance (TPA) member is located on a front section of the housing and is laterally movable on the front section between an unlocked position and a locked position. The TPA member comprises two spaced sections (the portion 34 and the member 36) configured to lock the electrical contact in the electrical contact receiving area at two spaced locations when the TPA member is moved to the locked position. Thus, they TPA system prevents unintentional withdrawal of the electrical contact from the electrical contact receiving area by the use of two spaced locks with the electrical contact. If the electrical contacts 14 are not fully inserted into the receiving areas, the TPA member will be prevented from moving to the locked position because of the outwardly deflected latch 26 and/or the contact of member 36 with the lateral side of the latch surface 44. In an alternate embodiment, any suitable type of system or camming engagement between the first part 17 of the TPA member and the second part 36 of the TPA member could be provided. Alternately, the camming engagement could be between the housing and the second part of the TPA member, such as if the second part is laterally movable on the housing for example. In this embodiment, the two spaced sections 34, 36 are located with the second one of the spaced sections 36 being located in front of the first one 34 of the spaced sections.

If it is desired to service the electrical connector and remove one or more contacts, the TPA member 16 can be slid in a direction reverse to direction 28 and the cam surface 52 can cam the projections 38 back down to the position shown in FIGS. 3-5.

Referring now to FIGS. 8-11, an alternate embodiment of the invention is shown. In this embodiment the connector 60 generally comprises a housing 62, terminals or electrical contacts 64, and a terminal position assurance (TPA) member or terminal lock 66. The housing 62 can comprise an inner housing 68 and an outer housing 70. However, in an alternate embodiment the housing could comprise more or less than two housing members. For example, the housing could comprise a one-piece member forming both the inner and outer housing sections. A seal 22 can be provided for sealing with a mating electrical connector (not shown). The inner housing 68 forms terminal receiving areas 74 which receive the electrical contacts 64. In this embodiment the inner housing 68 has a deflectable cantilevered latch arm 76 extending into each of the receiving areas 74. When one of the electrical contacts 64 is inserted into one of the receiving areas 74, one of the latch arms 76 can snap-lock latch with a portion of the electrical contact 64. This forms a first lock for locking the electrical contact in the housing.

Figure 8:
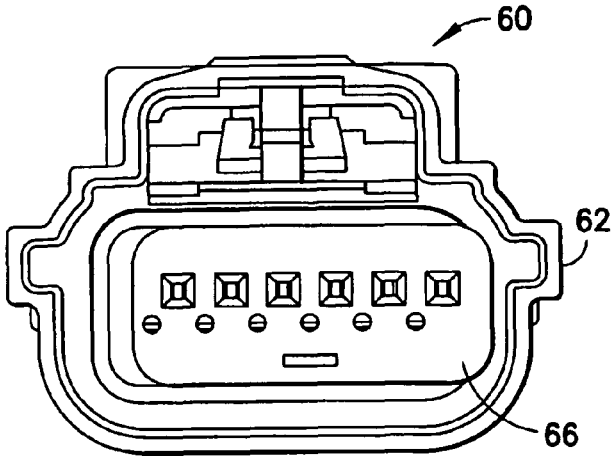
FIG. 8 is a front end view of an alternate embodiment of the invention.
Figure 10:
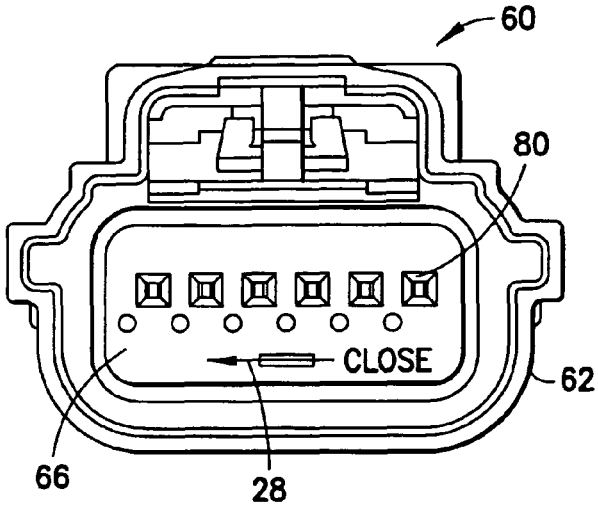
FIG. 10 is a front end view as in FIG. 8 showing the TPA member in a locked position.

The TPA member 66 is laterally movably as indicated by arrow 28 between an open position shown in FIG. 8 and a closed, locked position shown in FIG. 10. When the TPA member 66 is moved to the closed, locked position, the TPA insures that the terminals are properly axially positioned in the receiving areas 74, and also provide a secondary lock which locks the electrical contacts in the housing. In a preferred embodiment, the TPA member is slidably mounted on the front end of the inner housing 68, and a latch is provided to latch the TPA member 66 in the closed, locked position.

Figure 11:
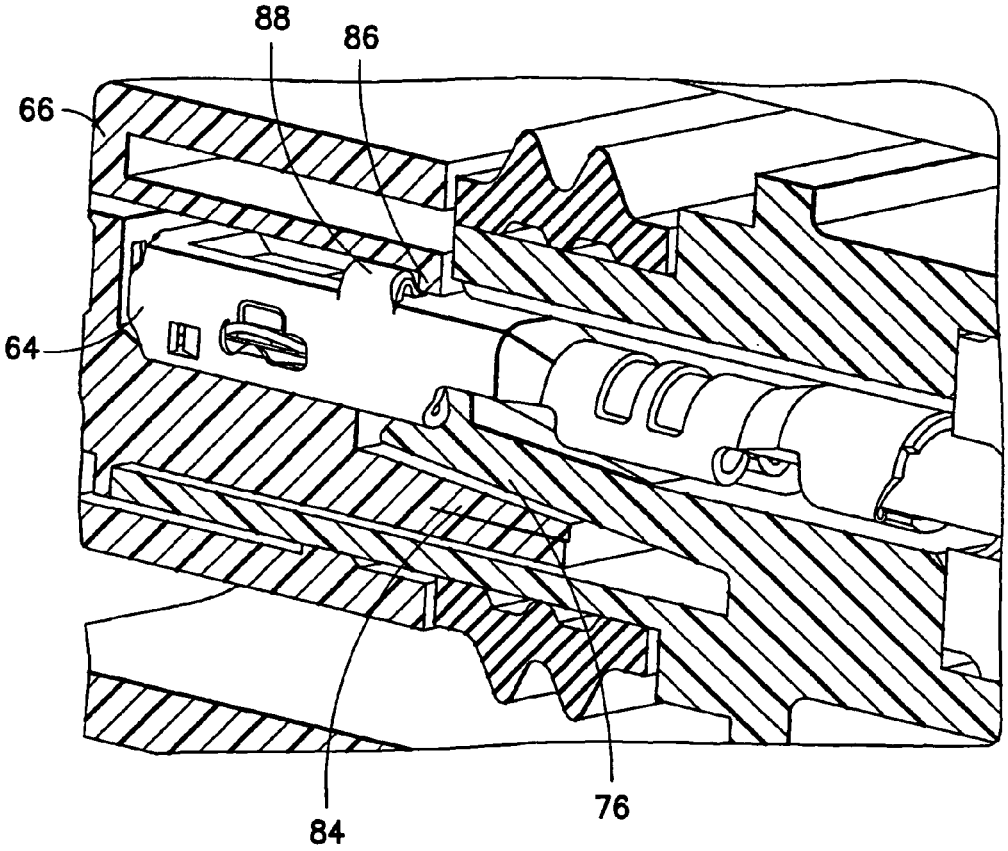
FIG. 11 is a partial cut away perspective view as in FIG. 9 but with the TPA member at a locked position.
Figure 12:
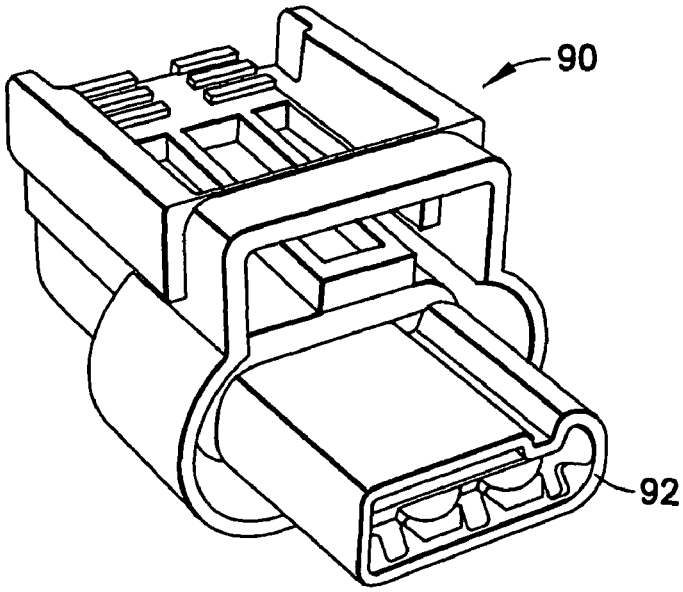
FIG. 12 is a perspective view of another alternate embodiment of the invention.

The front end of the TPA member 66 has apertures 80 to allow male contact pins (not shown) of a mating electrical connector to be inserted into the female electrical contacts 64. The front end of the TPA member 66 does not comprise the cam slots 32. A rear end of the TPA member 66 has portions 84 which, when the TPA member 66 is moved to the locked position, overly the latch arms 76 as seen in FIG. 11 and prevent the latch arms from deflecting out of engagement with the electrical contacts 64.

Figure 9:
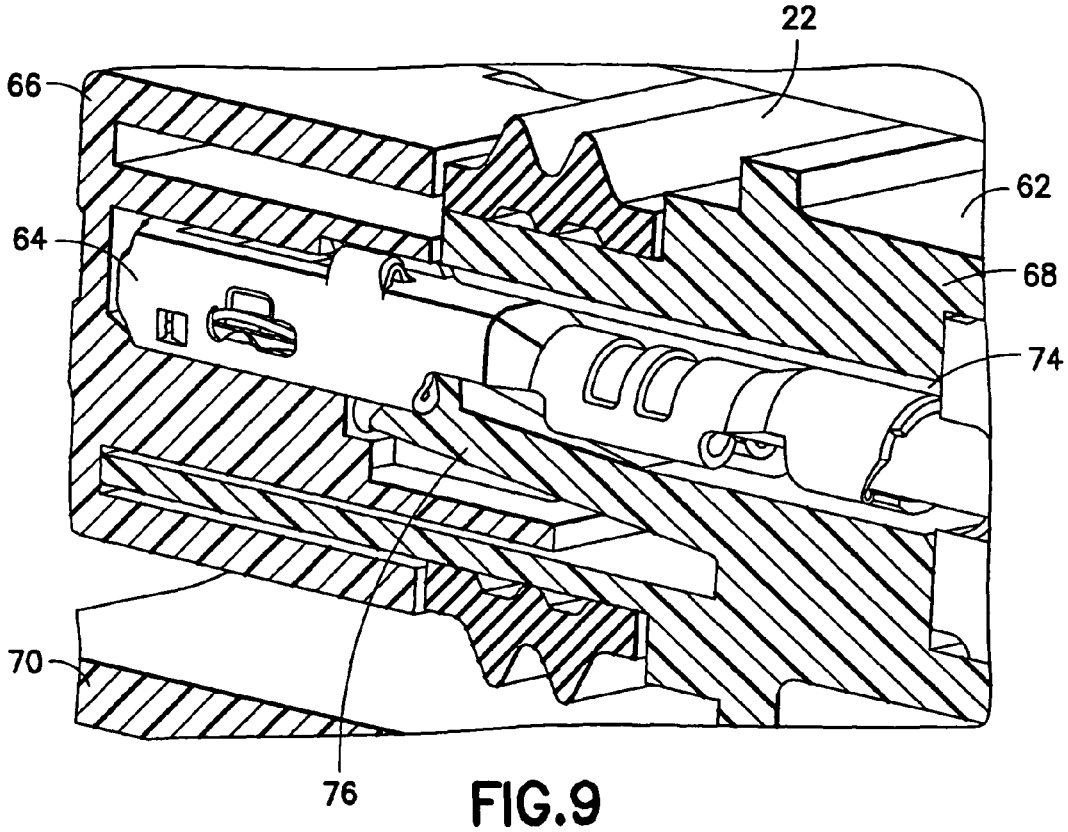
FIG. 9 is a partial cut away perspective view of the electrical connector shown in FIG. 8 with the TPA member at an unlocked position.

The TPA member 66 has secondary locks 86. When the TPA member 66 is moved to the locked position as shown in FIG. 11, the secondary locks 86 are slid laterally behind portions 88 of the electrical contacts 64 to lock the electrical contacts in the receiving areas. The rear side of the front end of the TPA member form a forward stop for the electrical contacts as illustrated in FIG. 9. In this embodiment the two spaced sections 84, 86 are located generally opposite each other on opposite sides of the TPA member. The two spaced sections are stationary sections on the TPA member.

Figure 14:
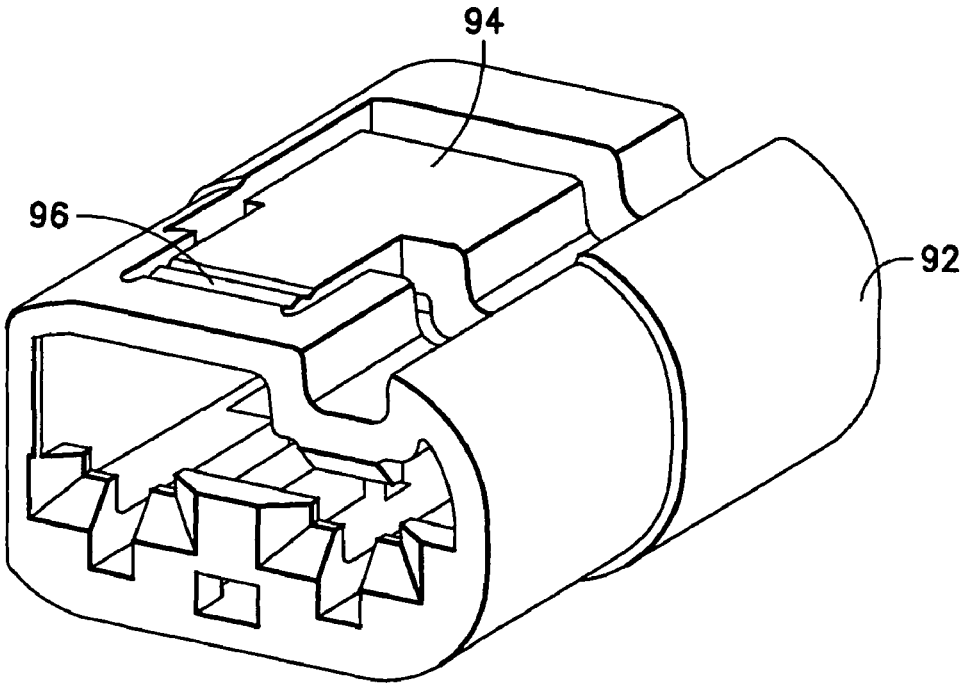
FIG. 14 is a perspective view of the TPA member shown in FIGS. 12-13.
Figure 13:
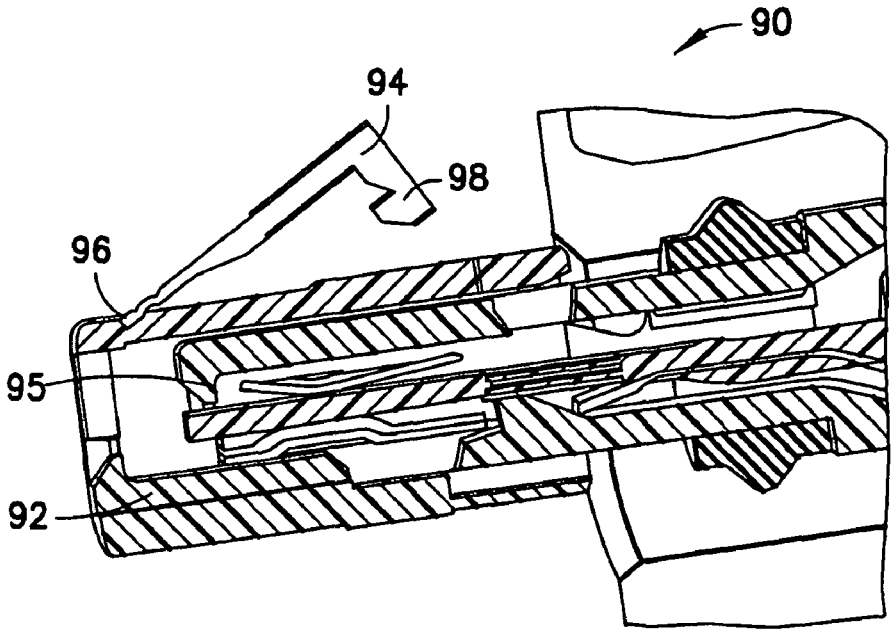
FIG. 13 is a partial cross sectional view of the electrical connector shown in FIG. 12 with the TPA member at an unlocked position.
Figure 15:
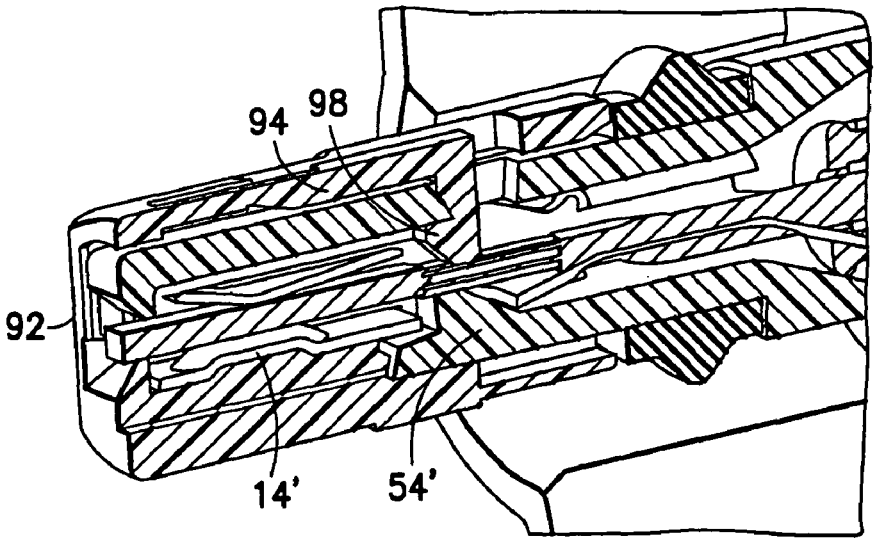
FIG. 15 is a partial cross sectional view similar to FIG. 13 showing the TPA member at a locked position.

Referring now to FIGS. 12-15, another alternate embodiment of the invention is shown. In this embodiment the electrical connector 90 is similar to the connector described in U.S. Pat. No. 7,044,806, which is hereby incorporated by reference in its entirety. However, in this embodiment the TPA member 92 comprises a secondary lock 94. The lock 94 is connected to the rest of the TPA member by a living hinge 96. However, in alternate embodiments any suitable type of connection could be provided. FIG. 13 shows the lock 94 in an open, pre-lock position. FIG. 14 shows the lock 94 pivoted down into a locked position; after the TPA member 92 has been axially inserted onto the inner housing member and backs up the primary terminal lock finger 54 of the inner housing. Thus, an axial TPA can be provided which ahs both a primary lock backup as well as a secondary lock. The secondary lock 94 has a portion 98 which passes through the inner housing and into a locking engagement with the electrical contact 14'. Thus, the TPA member provides support for the primary lock and also provides a secondary lock for keeping the electrical contact in the housing of the electrical connector. In this embodiment the inner housing forms the forward stop 95 for the contacts 14 in the receiving areas.

One of the features of the invention is a TPA which has primary locking, such as 34 and 26 for example, and secondary locking, such as 40 and 44 for example. The TPA member can comprise two spaced sections (such as 34 and 40 for example) configured to lock the electrical contact in the electrical contact receiving area at two spaced locations when the TPA member is moved to the locked position and thereby prevent unintentional withdrawal of the electrical contact from the electrical contact receiving area of the housing.

It should be understood that the foregoing description is only illustrative of the invention. Various alternatives and modifications can be devised by those skilled in the art without departing from the invention. For example, features recited in the various dependent claims could be combined with each other in any suitable combination(s). In addition, features from different embodiments described above could be selectively combined into a new embodiment. Accordingly, the invention is intended to embrace all such alternatives, modifications and variances which fall within the scope of the appended claims.

What is claimed is:

1. An electrical connector sub-assembly comprising:

a housing comprising electrical contact receiving areas, configured to receive electrical contacts, and at least one deflectable latch configured to latch an electrical contact in one of the electrical contact receiving areas; and a terminal position assurance (TPA) member located at a front end of the housing, wherein the TPA member comprises a main part which is movable on the housing between an unlocked position and a locked position, wherein the TPA member comprises a first section configured to block deflection of the deflectable latch and a second section configured to directly latch behind a portion of the electrical contact, wherein the second section is connected to the first section by a living hinge.

2. An electrical connector sub-assembly as in claim 1 wherein the first and second sections are located generally opposite each other on opposite sides of the TPA member.

3. An electrical connector sub-assembly as in claim 1 wherein the first section is a stationary section on the main part and the second section is movable relative to the first section.

4. An electrical connector sub-assembly as in claim 1 wherein the TPA member comprises the main part having the first section and a second part connected to the main part, wherein the main part and the second part are movable relative to each other.

5. An electrical connector sub-assembly as in claim 1 wherein the main part of the TPA member is configured to slide in a lateral direction on the housing from the unlocked position to the locked position.

6. An electrical connector comprising:

the electrical connector sub-assembly as in claim 1; and at least one electrical contact located in the at least one electrical contact receiving area.

7. An electrical connector sub-assembly as in claim 1 wherein the second section is adapted to pivot relative to the main part.

8. An electrical connector sub-assembly as in claim 7 wherein the first and second sections are located generally opposite each other on opposite sides of the TPA member.

9. An electrical connector sub-assembly as in claim 8 wherein the first and second sections are integrally formed as portions of a one-piece member.

10. An electrical connector sub-assembly as in claim 1 wherein the second section has a projection which is sized and shaped to project into a first hole in the electrical contact.

11. An electrical connector sub-assembly as in claim 10 wherein the deflectable latch is sized and shaped to project into a second hole in the electrical contact.

12. An electrical connector sub-assembly comprising:

a housing comprising electrical contact receiving areas, configured to receive electrical contacts, and at least one deflectable latch configured to latch an electrical contact in one of the electrical contact receiving areas; and a terminal position assurance (TPA) member located at a front end of the housing, wherein the TPA member comprises a main part which is movable on the housing between an unlocked position and locked position, wherein the TPA member comprises a first section configured to block deflection of the deflectable latch and a second section configured to directly latch behind a portion of the electrical contact, wherein the housing comprises an open area through the housing which is open from a front end of the housing to a rear side of the housing, wherein a rear end of the open area has a latching surface at the rear side of the housing, and wherein the open area is configured to allow a latch of a mating connector to extend through the open area and latch against the latching surface at the rear side of the housing.

13. A method comprising:

providing a housing comprising electrical contact receiving areas, configured to receive electrical contacts, and at least one deflectable latch configured to latch an electrical contact in one of the electrical contact receiving areas;

connecting a terminal position assurance (TPA) member to a front end of the housing, wherein the TPA member comprises a main part which is movable on the housing between an unlocked position and a locked position, wherein the TPA member comprises a first section configured to block deflection of the deflectable latch and a second section configured to directly latch behind a portion of the electrical contact, wherein the main part comprises a first side with a hole therethrough, wherein the second section extends from a front end of the main part into the hole in a general cantilever fashion; and moving the second section relative to the main section in the hole of the main part to locate a projection of the second section in a latching hole of the electrical contact.

14. A method as in claim 13 further comprising locating the first section under the deflectable latch at a bottom side of the housing, and locating the second section at the first side of the housing such that the deflectable latch projects into a bottom hole in the electrical contact and the projection on the second section projects into the latching hole in the electrical contact.

15. An electrical connector sub-assembly comprising:

a housing comprising electrical contact receiving areas, configured to receive electrical contacts, and at least one deflectable latch configured to latch an electrical contact in one of the electrical contact receiving areas; and a terminal position assurance (TPA) member located at a front end of the housing, wherein the TPA member comprises a main part which is movable on the housing between an unlocked position and a locked position, wherein the TPA member comprises a first section configured to block deflection of the deflectable latch and a second section configured to directly latch behind a portion of the electrical contact, wherein the second section is pivotably located at a top hole through a top side of the main part.

16. An electrical connector sub-assembly as in claim 15 wherein the first section is located at an opposite bottom side of the main part.

17. An electrical connector sub-assembly comprising:

a housing comprising electrical contact receiving areas, configured to receive electrical contacts, and at least one deflectable latch configured to latch an electrical contact in one of the electrical contact receiving areas; and a terminal position assurance (TPA) member located at a front end of the housing, wherein the TPA member comprises a main part which is movable on the housing between an unlocked position and a locked position, wherein the TPA member comprises a first section configured to block deflection of the deflectable latch and a second section configured to directly latch behind a portion of the electrical contact, wherein the main part comprises a first side with a hole therethrough, and wherein the second section extends from a front end of the main section into the hole in a general cantilever fashion.

18. An electrical connector sub-assembly as in claim 17 wherein the first section is located at an opposite second side of the main part.

19. An electrical connector sub-assembly comprising:

a housing comprising electrical contact receiving areas, configured to receive electrical contacts, and at least one deflectable latch configured to latch an electrical contact in one of the electrical contact receiving areas; and a terminal position assurance (TPA) member located at a front end of the housing, wherein the TPA member comprises a main part which is movable on the housing between a first position and a second position, wherein the TPA member comprises a first section configured to block deflection of the deflectable latch and a second section configured to directly latch behind a portion of the electrical contact, wherein the second section is adapted to pivot relative to the main part, wherein the first and second sections are located on opposite sides of the TPA member, and wherein the first and second sections are integrally formed as portions of a one-piece member, wherein the main part comprises a first side with a hole therethrough, and wherein the second section extends from a front end of the main section into the hole in a general cantilever fashion.

20. An electrical connector comprising:

the electrical connector sub-assembly as in claim 19; and electrical contacts located in the electrical contact receiving areas.

* * * * *